US007614199B2

(12) United States Patent
Smalley, III

(10) Patent No.: US 7,614,199 B2
(45) Date of Patent: Nov. 10, 2009

(54) METHOD AND SYSTEM FOR MODULAR BUILDING CONSTRUCTION

(76) Inventor: Arthur L. Smalley, III, 25802 Budde Rd., Spring, TX (US) 77380

( * ) Notice: Subject to any disclaimer, the term of this patent is extended or adjusted under 35 U.S.C. 154(b) by 866 days.

(21) Appl. No.: 10/992,497

(22) Filed: Nov. 18, 2004

(65) Prior Publication Data

US 2009/0000240 A1 Jan. 1, 2009

(51) Int. Cl.
*E04B 1/00* (2006.01)
*E04H 1/00* (2006.01)
*E04B 1/38* (2006.01)

(52) U.S. Cl. ..... 52/741.13; 52/235; 52/282.2

(58) Field of Classification Search ..... 52/239, 52/236.9, 235, 592.5, 741.13, 406.1, 300, 52/281, 282.2, 236.7, 220.2, 309.11
See application file for complete search history.

(56) References Cited

U.S. PATENT DOCUMENTS 4,104,837 A * 8/1978 Naito ..... 52/579
4,769,963 A * 9/1988 Meyerson ..... 52/309.9
4,777,774 A * 10/1988 Smalley, III ..... 52/282.3
4,944,127 A 7/1990 Clear
5,056,279 A 10/1991 Veldhoen
5,086,599 A * 2/1992 Meyerson ..... 52/309.9
5,237,790 A * 8/1993 Smalley ..... 52/282.3
5,285,607 A 2/1994 Somerville
5,293,725 A 3/1994 Matticks et al.
5,293,728 A * 3/1994 Christopher et al. ..... 52/588.1
5,448,865 A * 9/1995 Palmersten ..... 52/309.9
5,465,545 A 11/1995 Trousilek
5,809,715 A * 9/1998 Tanaka ..... 52/239
5,921,046 A 7/1999 Hammond, Jr.
6,041,562 A 3/2000 Martella et al.
6,122,879 A * 9/2000 Montes ..... 52/592.1
6,216,410 B1 * 4/2001 Haberman ..... 52/591.1
6,401,419 B1 6/2002 Béliveau
6,446,398 B2 * 9/2002 Weir ..... 52/71
6,481,172 B1 11/2002 Porter
6,493,995 B2 * 12/2002 McKenzie ..... 52/36.4
6,667,089 B1 12/2003 Barker
6,820,388 B2 * 11/2004 Newhouse et al. ..... 52/726.1

(Continued)

*Primary Examiner*—Richard E Chilcot, Jr.
*Assistant Examiner*—Mark R Wendell
(74) *Attorney, Agent, or Firm*—Brett T. Cooke; Andrews Kurth LLP

(57) ABSTRACT

A method and interlocking building system for construction of buildings capable of multiple stories from a variety of standard size panels and a variety of connectors for interlocking the panels. The panels may be horizontally disposed to form floors, ceilings or roofs or may be vertically disposed to form walls. The panels are formed of a plastic shell and contain a plurality of metal strips spaced therein and received within internal guide tracks or integral internal vertically-oriented trussing. The metal strips or trussing have interlocking tooth profiles which project beyond the plastic panel shell. When the panels are used as wall panels, the panels are preferably disposed so that the frame members are vertical. Panels may be interlocked, one vertically above the other, to form multiple stories, with the frame members of all stacked wall panels being in horizontal alignment to form generally continuous vertical strength members. Panels can also be interlocked side by side with integral mate and female sides to form continuous walls in a horizontal direction. A variety of 2-way, 3-way and 4-way connectors with male and/or female receptacles allow the panels to be interconnected in virtually unlimited ways to allow interconnection of both vertical and horizontal panels.

10 Claims, 8 Drawing Sheets

U.S. PATENT DOCUMENTS 7,067,588 B2 * 6/2006 Ritter et al. ..... 525/268
7,127,865 B2 * 10/2006 Douglas ..... 52/745.13
2002/0002804 A1 1/2002 Sheehy
2002/0020129 A1 2/2002 Winter
2004/0045238 A1 * 3/2004 Dunn et al. ..... 52/309.11

* cited by examiner

METHOD AND SYSTEM FOR MODULAR BUILDING CONSTRUCTION

BACKGROUND OF THE INVENTION

1. Field of the Invention

This invention relates to building components and to a method of assembling a building from pre-fabricated modular components.

2. Description of the Prior Art

There has long been a need for affordable, low-maintenance, building structures, particularly for commercial use. In the past quarter century, building construction costs on a cost per square foot basis have risen sharply. Consequently, in today's market, high building construction costs hinder many companies from building needed storage and warehouse facilities.

Conventional construction of buildings involves the erection of wood, metal or concrete framing. The exterior of the frame is generally covered with exterior paneling, bricks, stucco, rock, siding, or the like. Insulation is placed between the framing members, e.g., studs, and the interior of the frame is usually covered with gypsum drywall, plaster, interior paneling, or the like.

An alternative building construction technique, particularly useful for warehouses and other industrial buildings, involves forming the building walls from cinderblocks, bricks, or with a plurality of concrete panels which may be poured in place or preformed at a location other than the job site. The exterior side of the cinderblock, brick or concrete walls may or may not be covered with decorative paint or texture.

Considerable economies of scale can be achieved by the construction of buildings in modular fashion using prefabricated paneling in place of framing. The panels can be prefabricated in standard sizes by relatively high-speed automated factory manufacturing lines. The panels, which can be made from materials not subject to rot, weathering or insect attack, can be shipped to the job sites and simply assembled to erect complete structures. Generally, the lighter the panels are, the lower the costs are to transport the panels to the job site.

Several building systems exist which use modular interlocking components to form a building structure. Some interlocking modular building systems specify that a concrete-like mixture be poured within the assembled panels or other job-site procedure to fortify the structure. Other interlocking modular building systems sacrifice job-site fortification in exchange for lower limits of unsupported spans and building height. Other interlocking modular building systems attempt to strike a balance between these two extremes. Many interlocking panel systems also include a foam thermal insulation preformed in the panels for simplified building construction.

3. Identification of Objects of the Invention

One object of the invention is to provide a modular building system which is capable of being assembled into buildings not only of one story but also buildings having a plurality of stories without the need for a separate on-the-job-site fortification process and to provide the method of assembling a building from the system in order to quickly produce low costs single or multiple story buildings.

Another object of the invention is to provide a light-weight modular interlocking building system which is primarily constructed of thermally insulated plastic panels and which is capable of assembly into a building having multiple stories without the need for filling the panels with a concrete-like mixture or other on-the-job-site process to provide the needed strength to support multiple stories.

Another object of one of more embodiments of the invention is to provide a low cost construction technique in which portions of a building may be prefabricated in a factory using durable, long lasting materials which are not subject to rot, weathering or attack by insects.

Another object of one or more embodiments of the invention is to provide building components which are capable of low-cost factory manufacture and which may be erected to form an inexpensive building in a rapid and efficient manner using minimal on-site labor with minimal specialized skill and equipment.

Another object of the invention is to provide a system of complementary interlocking panels and connectors which can be combined in nearly limitless ways to build diverse structures of one or more stories.

Another object of the invention is to provide a system of complementary interlocking parts which can be used to construct building floors, walls and roofs.

Another object of the invention is to provide a modular interlocking building system which requires no special form of fasteners or use of specialized fastening tools.

Another object of the invention is to provide a low-cost flame-retardant ultra-violet resistant building capable of withstanding hurricane and earthquake shocks and characterized by a high floor loading capacity.

Another object of the invention is to provide a modular building system having prefabricated thermally-insulated panels with internal strength members.

Another object of the invention is to provide a modular interlocking building system particularly suited for multi-story warehouse and storage buildings.

SUMMARY OF THE INVENTION

The objects identified above, as well as other features and advantages of the invention are incorporated in a method for construction of buildings capable of one or multiple stories from an interlocking building system which preferably includes a variety of standard size panels and a variety of connectors for interlocking the panels. The panels may be horizontally oriented to form floors, ceilings, or roofs, or may be vertically oriented to form walls. The panels are preferably made of an extruded plastic and contain a plurality of metal strips spaced therein by a number of internal guide tracks or integral internal vertically-oriented trussing. The metal strips or internal trussing have interlocking tooth profiles which project beyond the face of each panel. Panels may be interlocked, one vertically above the other, to form multiple stories, with the frame members of all stacked wall panels being in horizontal alignment to form generally continuous vertical strength members. Panels can also be interlocked side by side with integral male and female sides to form continuous walls in a horizontal direction. A variety of 2-way, 3-way and 4-way connectors with male and/or female receptacles allow the panels to be interconnected in multiple ways to allow interconnection of both vertical and horizontal panels.

BRIEF DESCRIPTION OF THE DRAWINGS

The invention is described in detail below by reference to the embodiments illustrated in the accompanying figures, in which.

DESCRIPTION OF THE PREFERRED EMBODIMENT OF THE INVENTION

Figure 1:
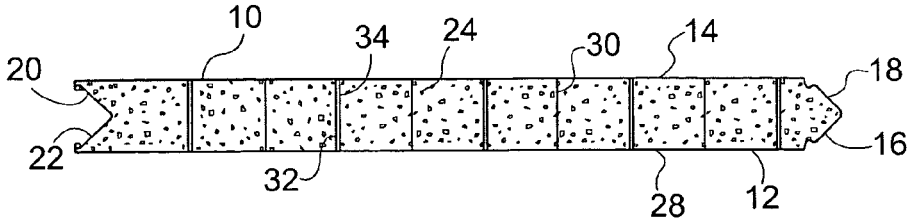
FIG. 1 is a top view of a wall panel of an interlocking building system showing a foam-filled interior with vertically aligned frame members and interlocking male and female connectors at the right and left sides.
Figure 2:
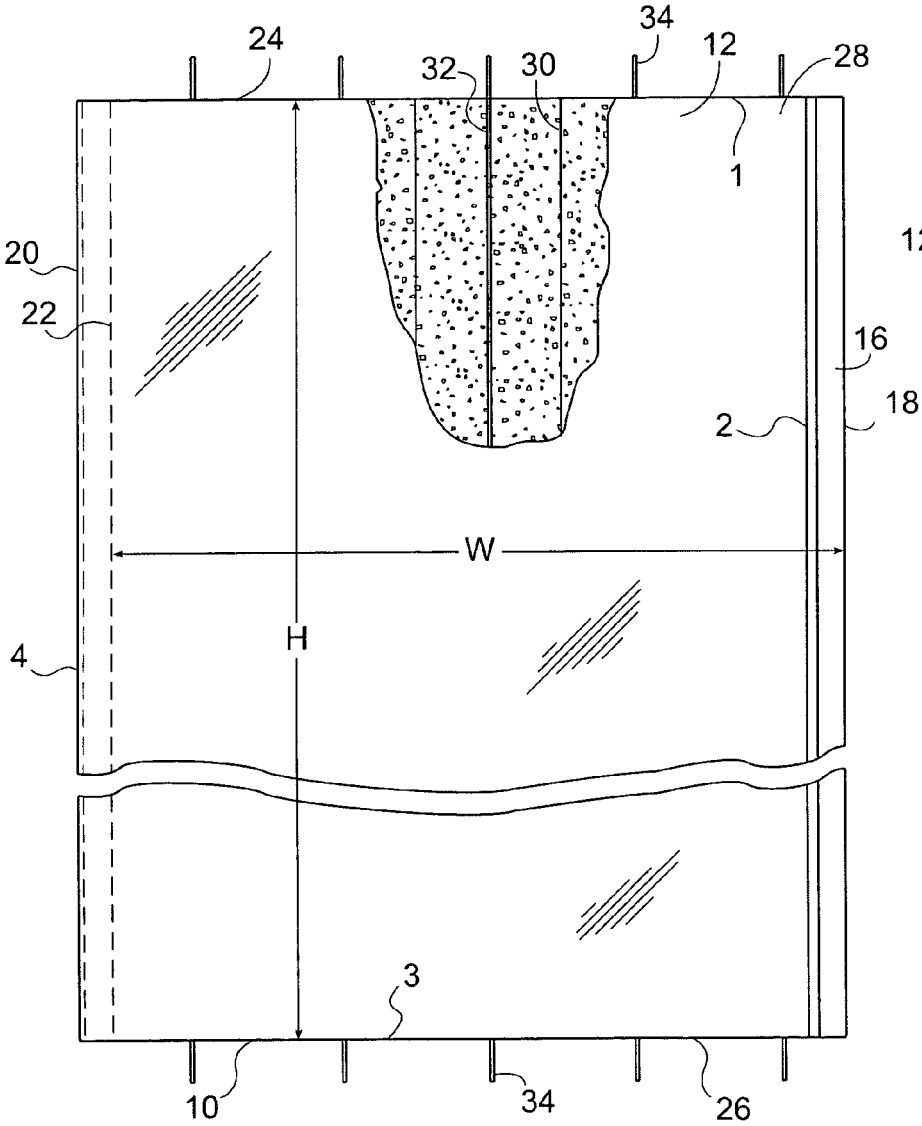
FIG. 2 is a front view of the wall panel of FIG. 1 with a partial cut-away of the panel face to reveal the interior construction.
Figure 3:
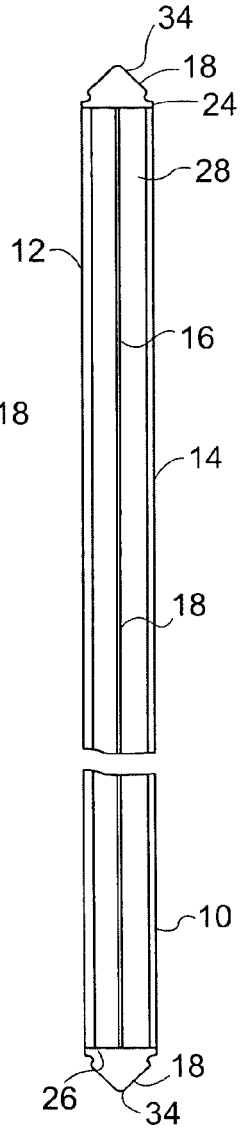
FIG. 3 is a side view of the wall panel of FIG. 1 showing projecting frame members having male connector profiles at the upper and lower distal ends of the panel.

A preferred embodiment of the invention includes a system of interlocking building components including one or more panels 10 as shown in orthogonal views in FIGS. 1-3. Panel 10 may be used to interchangeably form a portion of a wall surface, floor surface, ceiling surface, or a roof surface, but for simplicity, in FIGS. 1-3 the panel 10 will be described assuming an orientation as a wall surface. Thus, FIG. 1 shows a top view of a wall panel 10, FIG. 2 shows a front view of the wall panel 10, and FIG. 3 shows a side view of the wall panel 10. Wall panel 10 has two planar faces 12, 14, each having edges 1, 2, 3, 4 which form the vertical wall surfaces (or horizontal surfaces when panel 10 is used as a floor panel, for example) and which are both suitable for either indoor or outdoor use. Wall panel 10 has two distal ends 24, 26, either of which may be oriented to form the upper end or the lower end of the wall segment, provided any additional wall panel 10 which is connected to either distal end 24, 26 of the given wall panel 10 preferably maintains the same orientation. Panel 10 also has a male side 16 (having a male profile 18) and a female side 20 (having a female profile 22) for joining to other panels 10 or to other building system components.

As shown in FIGS. 1-3, panel 10 preferably has a one-piece extruded outer shell 28 which forms the faces 12, 14, male side 16, and female side 20. Although the shell is preferably manufactured in an extrusion process, molding or other suitable processes may be used. For example, the shell 28 may be formed by two or more pieces joined together by bonding, welding or other means. Although the shell 28 may be made of any suitable material, it is preferably formed of a polymer, for example, polyvinylchloride (PVC). The compound or mixture may optimally include flame retardants and ultraviolet stabilizers.

A variety of panel thicknesses may be used, where thickness is defined as the distance between planar faces 12 and 14. For example, panel 10 may be thicker or thinner than the thickness of conventionally constructed walls or floors. A panel thickness of about three inches should be adequate for most building applications. The two planar faces 12, 14 are preferably maintained in a parallel relation and prevented from bowing by a plurality of ribs 30 which are preferably perpendicularly disposed between and integral with the faces 12, 14, which extend from distal end 24 to distal end 26, and which are spaced between the male side 16 and the female side 20 of panel 10. Rib spacing may vary, but it is preferably about six inches. Frame members 32 are placed parallel with and preferably spaced midway between the ribs 30. The frame members 32 are preferably steel strips, although other suitable shapes or material may be used. The frame members 32 protrude beyond the shell 28 at the distal ends 24, 26 to form teeth 34. The projecting teeth 34 are shaped to form the same male profile 18 as used with male side 16, except that each tooth profile of teeth 34 is perpendicular to the male side 16 profile. The positioning of the frame members 32 may vary from embodiment to embodiment, but should remain consistent within a given building system so that when a second wall panel 10 is connected distal end to distal end to a given wall panel 10 (i.e., one wall panel is stacked directly above the other), the frame members 32 of the second wall panel horizontally align with the frame members 32 of the given wall panel 10 to form a generally continuous vertical support. The void spaces within the shell 28 between the ribs 30 and the frame members 32 are preferably filled with a foam thermal insulation material.

Panel 10 is ideally manufactured in a variety of standard sizes to allow buildings of various dimensions and complexities to be built entirely from the building system of the invention. If the shell 28 is made using the preferred extrusion process, it can be cut to various lengths, where length is defined as the distance between distal ends 24 and 26 exclusive of the teeth 34. For example, standard panel heights or lengths H of 8 and 10 feet will allow for standard ceiling heights of 8 and 10 feet. Likewise, by changing the extrusion dies, panel width, defined as the distance between the tip of the male profile 18 and the corresponding mating position within the female profile 22, can be changed. For example, panel 10 can be manufactured in standard widths of 2, 2.5, 3, 3.5 and 4 feet and beyond.

Figure 4:
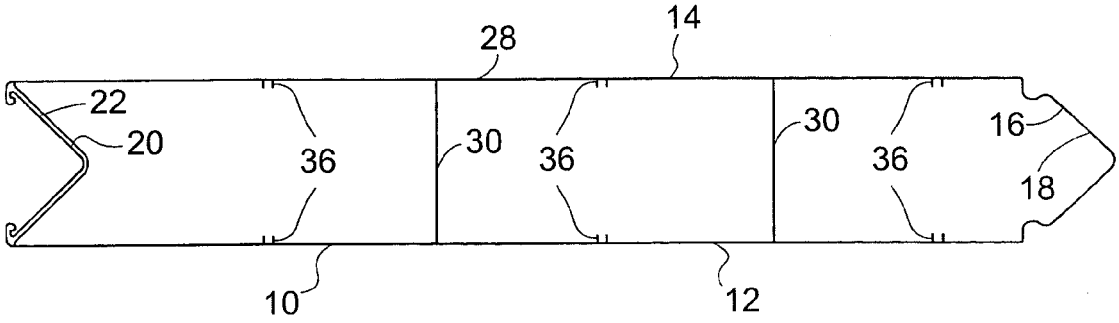
FIG. 4 is a profile illustration of a panel shell of the interlocking building system of the preferred embodiment according to the invention showing guide tracks for receiving framing members.

FIG. 4 shows one possible extrusion profile of a one-piece shell 28 of panel 10. The shell preferably includes guide tracks 36 for receiving and holding frame members 32. A number of structures may be used to form the guide tracks 36. For example, if there is adequate material, recessed slots may be formed in the interior surface of the faces 12, 14. Alternatively, the guide tracks may extend from the interior surface of the faces 12, 14 into the void as shown in FIG. 4. After the shell is extruded and cut to length, steel strips of appropriate length, with ends punched to form teeth 34 with male profiles 18, are inserted into the tracks 36 to form the frame members 32. Various types and thicknesses of steel strips are suitable for use. For example, eighteen gauge mild steel in roughly 3 inch strips at 6 inch intervals can be provided to support a multistory building with a floor loading capacity suitable for mini-storage warehouse use.

Figure 5:
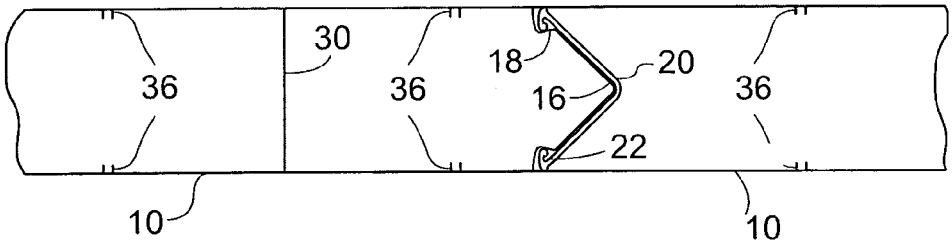
FIG. 5 is a profile illustration of two panel shells of FIG. 4 showing a male side interlocked with a female side.

As illustrated in FIG. 5, the male side 16 having the male profile 18 is designed to interlock with the female side 20 having a female profile 22. Accordingly, a plurality of panels 10 can be arranged male side 16 of one to female side 20 of another and interlocked to form a continuous wall (or floor, etc.). No separate connector is needed for the side to side connection of panels 10 Various interlocking arrangements are known in the art and can be used. The male profile 18 described herein, for example, is arrow-shaped with a tip angle of about 93 degrees, and the female profile 22 has a complementary shape but with a receiving angle of only 90 degrees. The male profile is designed and arranged to snap into and be held tightly by the female profile 22. Under a substantial force, the female side spreads to receive the male side. Once the male side is received, the resiliency of the shell material causes the female side to close around and capture the received male side. Another interlocking arrangement is shown in U.S. Pat. No. 5,237,790, issued to Smalley, which is incorporated herein by reference.

Figure 6:
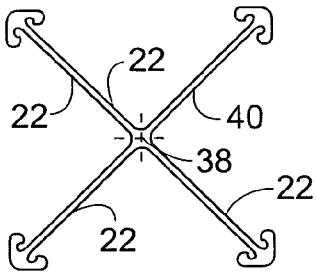
FIG. 6 is a profile illustration of a universal connector of the interlocking building system of the preferred embodiment according to the invention showing the connector with four female profiles each being arranged and designed to mate with a corresponding male profile.

Referring to FIG. 6, a second component of the interlocking building system of the preferred embodiment according to the invention is shown. FIG. 6 shows the end profile of a universal connector 40. The connector 40 is preferably fabricated in assorted lengths. One length is specified to match the height H of the panels. Other lengths are specified to match the width W of one or more interconnected panels.

Figure 7:
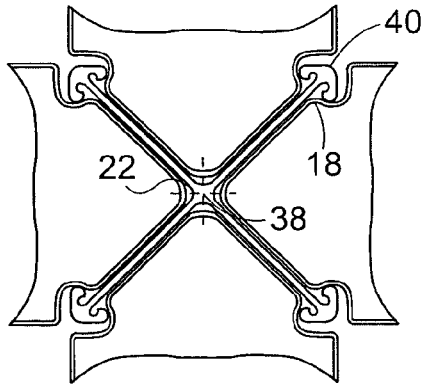
FIG. 7 is a profile illustration of the universal connector of FIG. 6 showing the female connector connecting male profiles of four panels of FIG. 1*k;*
Figure 8:
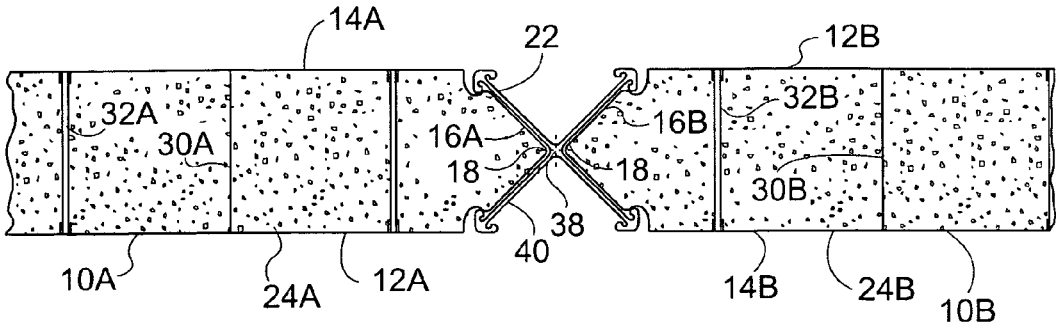
FIG. 8 is a cross-sectional top view of two wall panels of FIG. 1 interlocked male side to male side using a vertically disposed universal connector of FIG. 6.

The universal connector 40 is preferably made from the same material as the shell 28 of panel 10 (FIGS. 1-3), such as PVC, but other resilient materials may be used. Additionally, the connector 40 is preferably extruded, although other manufacturing processes may be used. The universal connector 40 includes four slots each having a female profile 22 essentially identical to that of the female side 20 of panel 10. The four female profiles 22 are oriented at ninety degree intervals about a common longitudinal axis 38. In other words, there are two perpendicular pairs of opposing longitudinal female receptacles. Each female profile 22 on the four-female-style connector 40 is designed to interlock with a male profile 18. FIG. 7 shows the universal connector 40 fully populated with four male profiles 18, each being the male side 16 of a panel 10 or the projecting teeth 34 of a panel 10. FIG. 8 is a top view of two wall panels 10A, 10B, with the two male sides 16A, 16B interlocked into a common universal connector 40. The connector 40 shown in FIG. 8 is oriented vertically so as to interconnect two vertically oriented panels 10A, 10B. Alternatively, FIG. 8 can equally depict the distal ends 24A, 24B of two floor panels 10A, 10B horizontally disposed and connected male side 16A to male side 16B. In this case, connector 40 has its longitudinal axis in a horizontal position.

Figure 9:
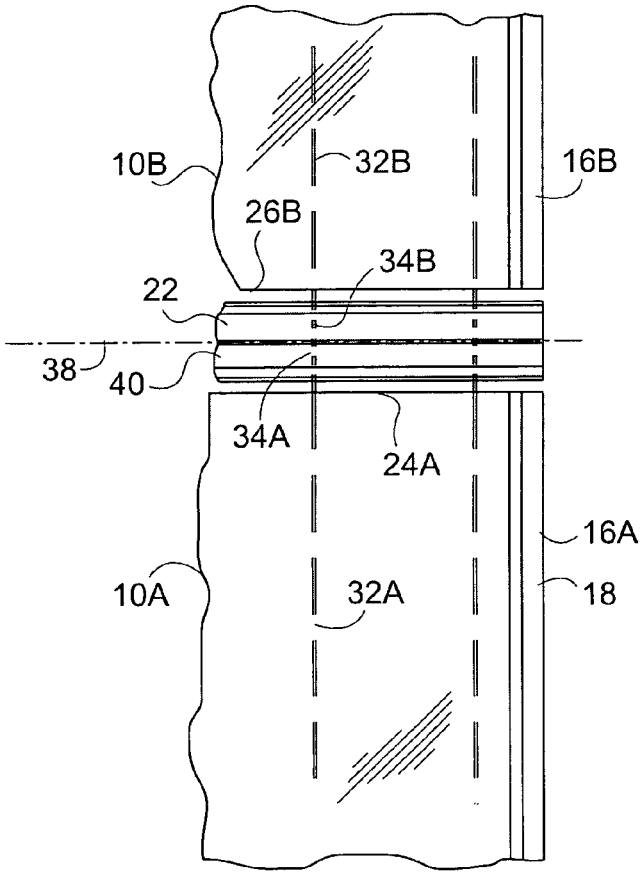
FIG. 9 is a front view of two wall panels of FIG. 1 connected distal end to distal end using a horizontally disposed universal connector of FIG. 6 to form multiple stories.
Figure 10:
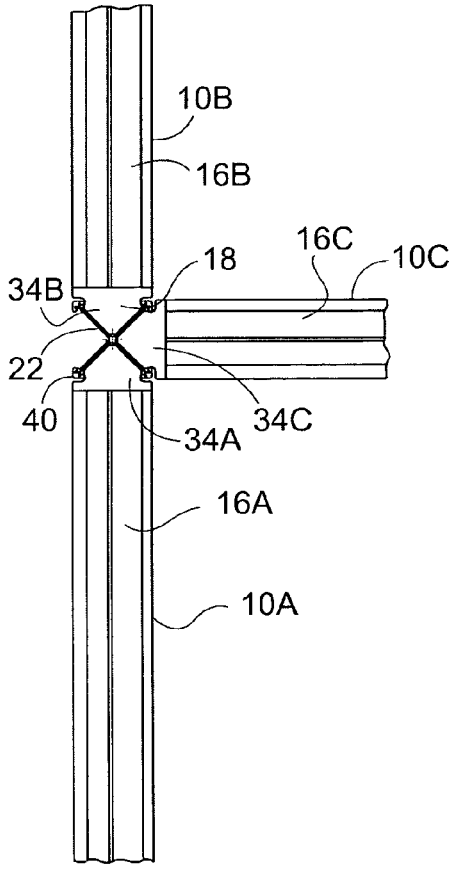
FIG. 10 is a side view of FIG. 9 showing, in addition to the two interlocked wall panels, a floor panel interlocked using the horizontally disposed universal connector.

The universal connector 40 can be used with its longitudinal axis 38 vertically disposed to connect two, three or four wall panels 10 together. The universal connector 40 can also be used with its longitudinal axis 38 disposed horizontally to connect the distal ends 24A, 26B of two wall panels 10 together to form multiple stories, to connect a floor, ceiling or roof panel 10 to a wall panel 10, to connect two floor panels 10 together, or a combination thereof. FIGS. 9 and 10 show front and side views, respectively, of a building joint formed by two wall panels 10A, 10B, a floor panel 10C and a horizontally disposed universal connector 40. The wall panels 10A, 10B are oriented so that frame members 32A, 32B are vertical and aligned to form nearly continuous vertical support members to support multiple stories. Floor panel 10C is shown, like wall panels 10A, 10B, with teeth 34C engaged with connector 40, but floor panel 10C may equally be horizontally rotated so that male side 16 engages connector 40.

Figure 11:
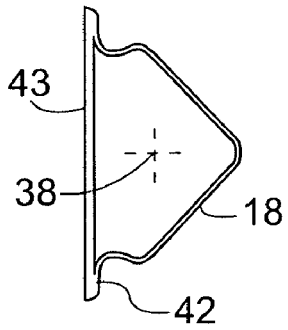
FIG. 11 is a profile view of a blank adapter of the interlocking building system of the preferred embodiment according to the invention used for filling a vacant female profile of a connector of the interlocking building system, such as the universal connector of FIG. 6, for example.
Figure 12:
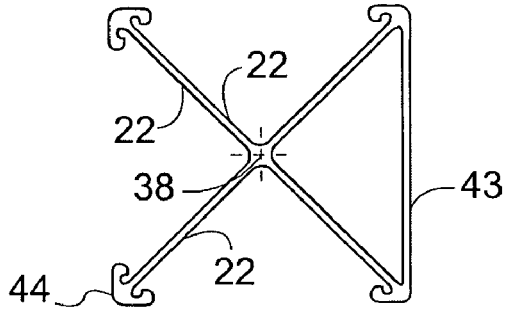
FIG. 12 is a profile view of a blanked connector of the interlocking building system of the preferred embodiment according to the invention showing three female profiles and one blank side.
Figure 13:
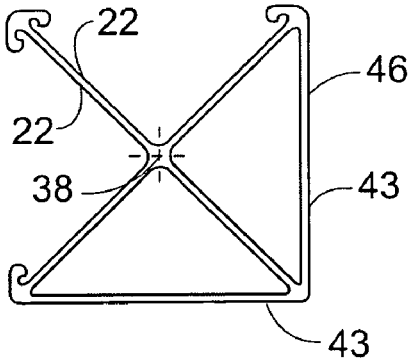
FIG. 13 is a profile view of a blanked connector of the interlocking building system of the preferred embodiment according to the invention showing two adjacent female profiles and two adjacent blank sides.
Figure 14:
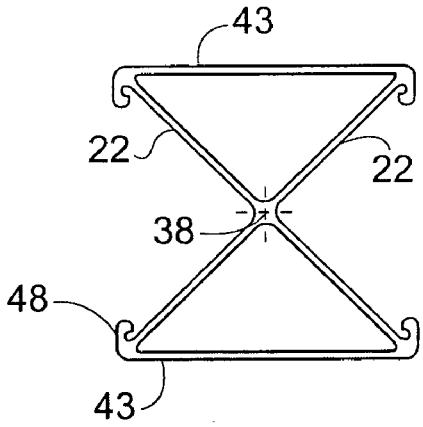
FIG. 14 is a profile view of a blanked connector of the interlocking building system of the preferred embodiment according to the invention showing two oppositely positioned female profiles and two oppositely positioned blank sides.

The universal connector 40 often does not need all four female receptacles when disposed in a given location within the building structure. When vacant female profiles 22 are deemed to be unsightly, a blank adapter 42 with a single male profile 18 and a blank side 43 may be snapped into a female profile 22 in a connector 40 to close that receptacle. FIG. 11 shows a profile of one possible blank adapter 42. Alternatively, as illustrated in FIGS. 12-14, specialized blanked-connectors 44, 46, 48 having one or more preformed blank sides 43 in place of the standard female profile 22 may be provided. Like the universal connector 40, the blank adapter 42 and the blanked-connectors 44, 46, 48 are preferably extruded from the same material as the shell 28 of panel 10 (FIG. 4), such as PVC, but other resilient materials or manufacturing processes may be used. The length of the blank adapter 42 and the blanked-connectors 44, 46, 48 may vary, but they preferably come in sizes to match the height H or the width W of the panel.

Figure 15:
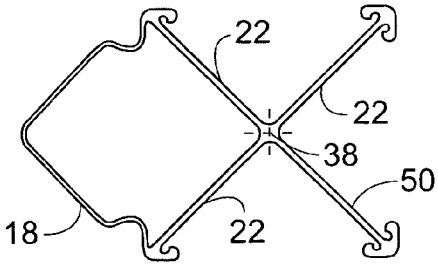
FIG. 15 is a profile view of a hybrid connector of the interlocking building system of the preferred embodiment according to the invention showing one male profile and three female profiles.
Figure 16:
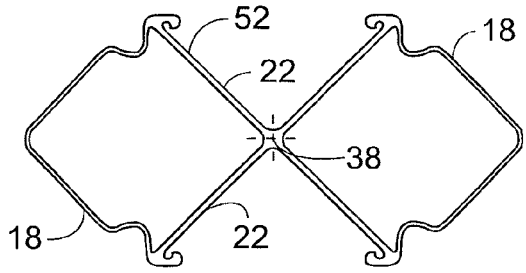
FIG. 16 is a profile view of a hybrid connector of the interlocking building system of the preferred embodiment according to the invention showing two oppositely positioned male profiles and two oppositely positioned female profiles.
Figure 17:
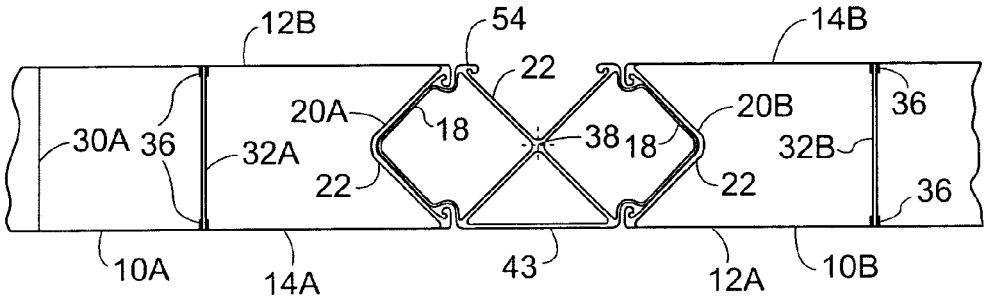
FIG. 17 is a top view of two wall panels of FIG. 1 interlocked female side to female side using a vertically disposed hybrid connector having two oppositely positioned male profiles, one female profile and one blank side.

Referring to FIGS. 15-17, there may be situations where it is preferable to have a connector which is capable of interlocking with the female side 20 of a panel 10. FIG. 15 shows a connector 50 which has three female profiles 22 and one male profile 18. FIG. 16 shows a connector 52 which has two oppositely positioned female profiles 22 and two oppositely positioned male profiles 18. Additional connectors having different combinations of male profiles 18, female profiles 22, and/or blank sides 43 can be provided as desired. For example, FIG. 17 shows two panels 10A, 10B interconnected at female sides 20A, 20B, by connector 54. In addition to the two oppositely positioned male profiles 18, connector 54 has one female profile 22 and one blank side 43. Connectors 50, 52, 54 and connectors with other combinations of profiles are preferably extruded from the same material as the shell 28 of panel 10 (FIG. 4), such as PVC, but other resilient materials or manufacturing processes may be used. The available lengths of the connectors preferably corresponds to the standard available lengths the universal connector 40.

Figure 18:
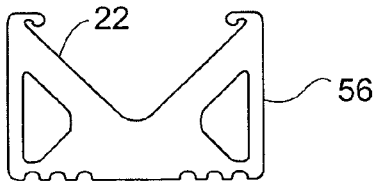
FIG. 18 is a profile view of a footer device of the interlocking building system of the preferred embodiment according to the invention showing a single female profile for receiving the lower projecting teeth of the wall panel of FIGS. 2-3 and a lower surface for support on a slab or other flat surface.

FIG. 18 illustrates a preferred profile for a footer device 56 for the interlocking building system of the preferred embodiment according to the invention. The walls of a building constructed using this system preferably use wall panels 10 oriented so that frame members 32 are vertical. Thus, the projecting teeth 34 at the lower distal ends of the ground floor wall panels 10 can be connected to footer device 56 to provide a continuous bottom surface which can be placed directly on a slab or other generally flat surface. Multiple stories may be stacked on top of the ground floor wall panels. The frame members 32 in the wall panels 10 of an upper story align with the frame members 32 in the wall panels 10 in the story directly below, with the teeth 34 of the upper and lower wall panels being interlocked in oppositely positioned female profiles 22 of a horizontally disposed connector, for example universal connector 40. The interlocking joints of the building may be solvent welded if desired to add strength and permanency to the building structure, Additionally, the joints may be caulked to seal the building and to provide a more aesthetic and finished appearance.

Figure 19:
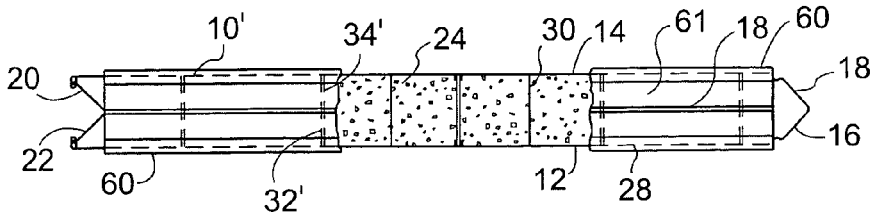
FIG. 19 is a top view with partial cutaway of a wall panel of an interlocking building system showing a foam-filled interior with vertically aligned frame members, covers with interlocking male profile over the distal ends of the panel, and interlocking male and female connectors at the right and left sides of the panel.
Figure 20:
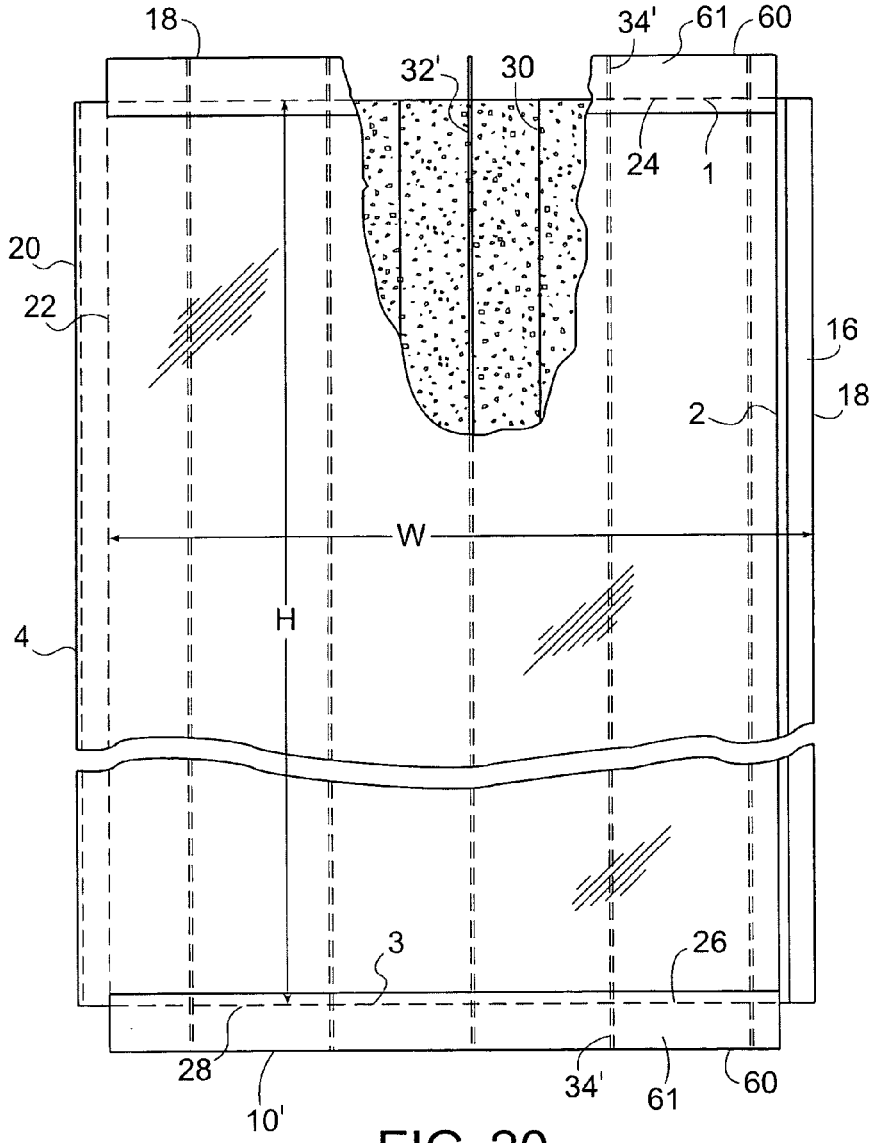
FIG. 20 is a front view of the wall panel of FIG. 19 with a partial cut-away of the panel face to reveal the interior construction.
Figure 21:
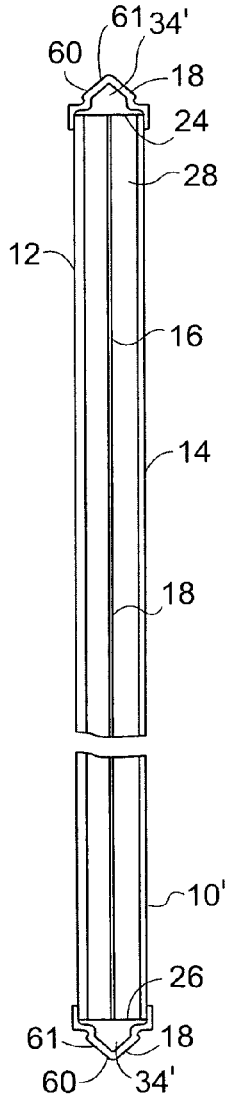
FIG. 21 is a side view of the wall panel of FIG. 19 showing projecting frame members and covers which have male connector profiles and located at the upper and lower distal ends of the panel.

FIGS. 19-21 depict an alternate embodiment of panel 10' according to the invention. Panel 10' has a structure similar to that of panel 10 of FIGS. 1-3, except that the projecting teeth 34' at distal ends 24, 26 are concealed by a cover 60 having an outer surface 61 with male profile 18. Each cover 60 preferably sheathes all of the teeth 34' at a given distal end 24, 26 to form a continuous male connector like that of male side 16. In order to accommodate cover 60 having an outer male profile 18, teeth 34' preferably have a slightly smaller tooth profile than teeth 34 of panel 10 of FIGS. 1-3 (which are the same as male profile 18).

The cover 60 is preferably made from the same material as the shell 28 of panel 10', such as PVC, but other suitable materials may be used. The cover 60 is preferably extruded, although other manufacturing processes may be used. The covers 60 are preferably solvent welded to distal ends 24, 26 of panel 10' after frame members 32' and foam are put in place, although other processes or sequences may be used.

Figure 22:
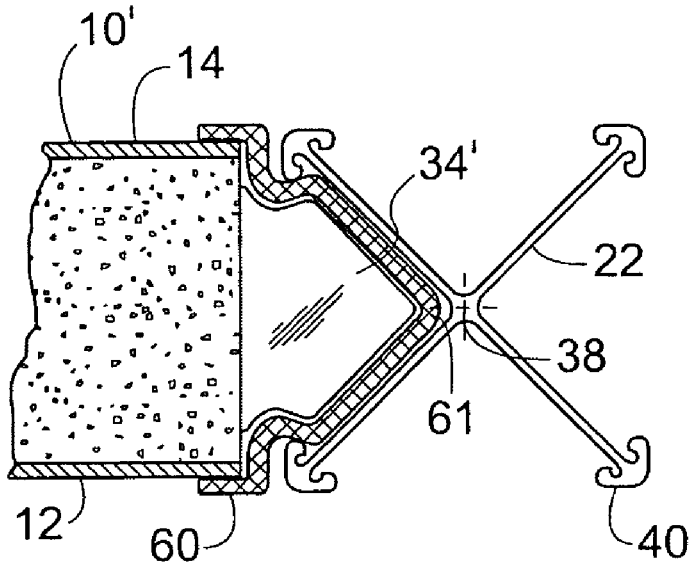
FIG. 22 is a profile cross-section of a distal end of a panel of FIG. 19 with a cover interlocked with a connector of FIG. 6.

FIG. 22 is a cross-sectional profile of cover 60 attached with panel 10' and mounted in a universal connector 40. Cover 60 is preferably designed and arranged to receive a distal end 24, 26 of panel 10' and overlap a small distance over faces 12, 14. The interface between the overlap of cover 60 and faces 12, 14 may be solvent welded or similarly attached if desired. Cover 60 provides a clean finished appearance to a building constructed using panels 10' of this embodiment and prevents water ingress into panels 10' during inclement weather.

Figure 23:
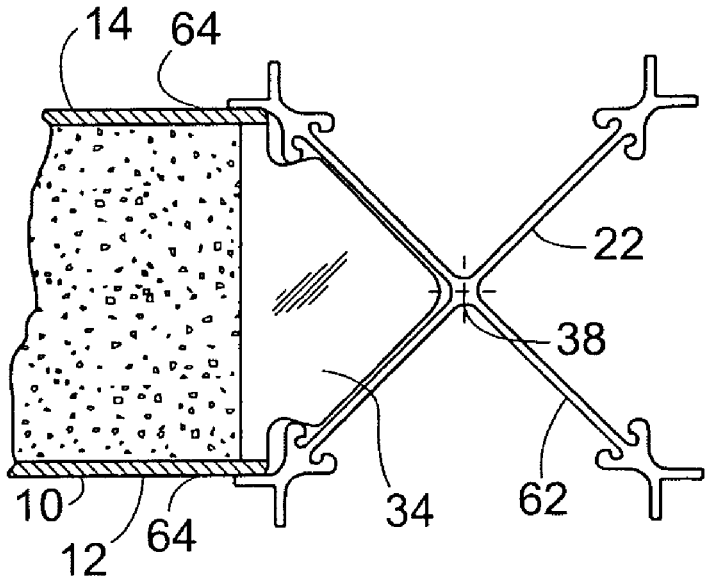
FIG. 23 is a profile cross-section of a distal end of a panel of FIG. 1 interlocked with a modified universal connector of the interlocking building system of the preferred embodiment according to the invention.

Alternatively, as shown in FIG. 23, a modified universal-style connector 62, as well as other styles of connectors, may be used to envelope the teeth 34 of the panel 10 of FIGS. 1-3 in such a way as to provide a clean finished appearance and to prevent water ingress into the panel 10. Modified connector 62 has surfaces 64 which overlap and may be sealed with faces 12, 14, for example, by solvent welding.

Figure 24:
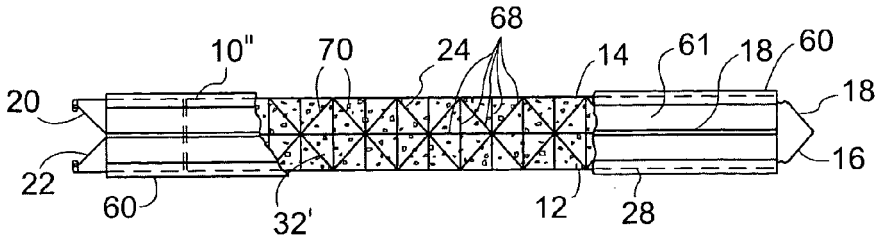
FIG. 24 is a top view with a partial cutaway of a wall panel of another embodiment of the invention showing a foam-filled interior and integral interior vertically-oriented trussing.
Figure 25:
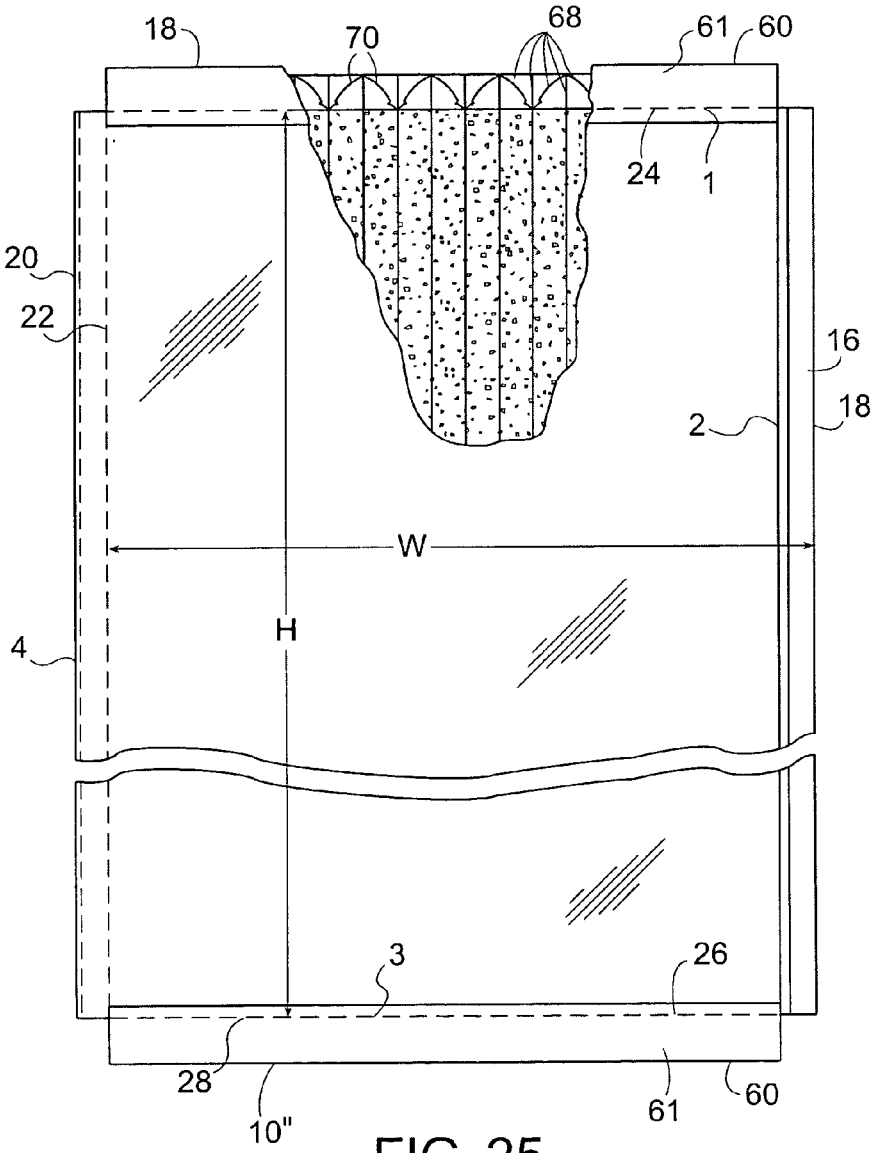
FIG. 25 is a front view of the wall panel of FIG. 24 with a portion cut away to reveal the internal construction and the projection trussing with an overall male profile.
Figure 26:
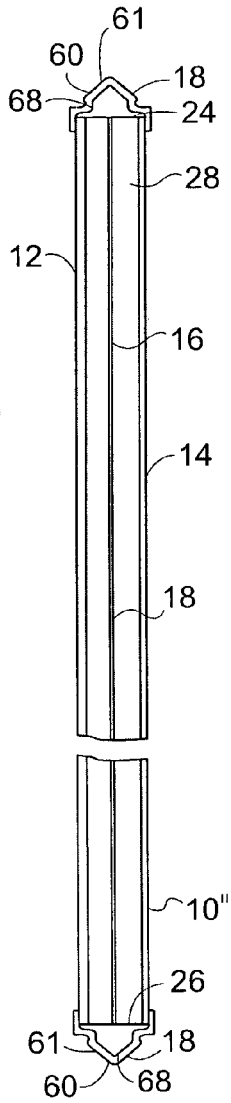
FIG. 26 is a side view of the wall panel of FIG. 24 showing projecting trussing and covers which have male connector profiles located at the upper and lower distal ends of the panel.

FIGS. 24-26 illustrate an alternate embodiment of the invention. In place of ribs 30 and metal strips frame members 32 of panel 10 (see FIGS. 1-3), panel 10" employs vertically oriented vertical trussing 68. Trussing 68 is preferably constructed of the same material as and is integral with shell 28. Trussing 68 may be extruded in the same manufacturing step as the extrusion of shell 28. Like the frame members 32 of panel 10 (see FIGS. 1-3), trussing 68 projects beyond panel faces 12, 14 and are shaped with an overall male profile 18 (not shown). The diagonal truss ribs 70 have an altered profile shape which results in the male profile 18 when viewed from the side. Alternatively, as shown in FIGS. 24-26, the projecting trussing 68 may be shaped with an overall profile which is slightly smaller than male profile 18 to accommodate covers 60 which have an other surface with the standard male profile 18.

While one or more embodiments of the invention have been illustrated in detail, the invention is not limited to the embodiments shown; it is apparent that modifications and adaptations of the above embodiments will occur to those skilled in the art. Such modifications and adaptations are in the spirit and scope of the invention as set forth herein:

The invention claimed is:

1. A panel (10) for building construction comprising, first and second generally planar and rectangular faces (12, 14) having substantially equal sizes and disposed parallel to one another, each of said faces (12, 14) having first, second, third and fourth edges (1, 2, 3, 4), a first side (16) coupled between said second edge (2) of said first face (12) and said second edge (2) of said second face (14), a second side (20) coupled between said fourth edge (4) of said first face (12) and said fourth edge (4) of said second face (14), at least one strip (32) disposed between said first and second faces (12, 14) so that the length of said strip is parallel to said second edge of said first face, said second edge of said second face, said fourth edge of said first face, and said fourth edge of said second face, said at least one strip (32, 68) defining a first projection (34) beyond said first edge (1) of said first face (12) and said first edge (1) of said second face (14), said first projection defining a tooth connection profile, and at least one guide track (36) designed and arranged for receiving said at least one strip (32).

2. The panel of claim 1 wherein, said at least one strip (32) further defines a second projection (34) beyond said third edge (3) of said first face (12) and said third edge (3) of said second face (14), said second projection having a shape of said tooth connection profile.

3. The panel of claim 2 wherein, said first side (16) has a shape of a first connection profile (18), and said second side (20) has a shape of a second connection profile (22), wherein said first connection profile (18) is designed and arranged to interlock with said second connection profile.

4. The panel of claim 1 wherein, said first and second faces (12, 14) and said first and second sides (16, 20) are integrally formed.

5. The panel of claim 1 wherein, said first and second faces (12, 14) are made of plastic, and said at least one strip (32) is made of metal.

6. The panel of claim 1 wherein, said tooth connection profile is said first connection profile (18).

7. The panel of claim 1 further comprising, a first cover (60) generally overlapping and coupled between said first edge (1) of said first face (12) and said first edge (1) of said second face (14) and receiving said first projection (34) of said at least one strip (32), said first cover (60) having an outer surface (61) with said first connection profile (18), and a second cover (60) generally overlapping and coupled between said second edge (2) of said first face (12) and said second edge (1) of said second face (14) and receiving said second projection (34) of said at least one strip (32), said second cover (60) having an outer surface (61) with said first connection profile (18).

8. A system of building components comprising, a panel (10) characterized by having a first generally planar plastic face (12) coupled to a second generally planar plastic face (14), said second face (14) oriented generally parallel to said first face (12) and defined and bounded by first, second, third and fourth edges (1, 2, 3, 4) that are generally aligned with first, second, third and fourth edges (1, 2, 3, 4) that define and bound said first face (12), a plurality of metal strips (32) each transversely coupled between said first and second faces (12, 14) and disposed so that its length is parallel to said second and fourth edges (2, 4) of said first face (12), each of said plurality of strips (32) defining a projection (34) beyond said first edge (1) of said first face (12) that forms a first interlocking profile (18), and a connector (40) having a plurality of second interlocking profiles (22) designed and arranged to interlock with said first interlocking profile (18).

9. A system of building components comprising, a panel (10) characterized by having a first generally planar plastic face (12) coupled to a second generally planar plastic face (14), said second face (14) oriented generally parallel to said first face (12) and defined and bounded by first, second, third and fourth edges (1, 2, 3, 4) that are generally aligned with first, second, third and fourth edges (1, 2, 3, 4) that define and bound said first face (12), a plurality of truss members (68) disposed between and integrally formed with said first and second faces (12, 14), each of said plurality truss members (68) oriented so that its length is parallel to said second and fourth edges of said first face, each of said plurality of truss members defining a projection (34) beyond said first edge (1) of said first face (12), said projection forming a first interlocking profile (18), and a connector (40) having a plurality of second interlocking profiles (22) designed and arranged to interlock with said first interlocking profile (18).

10. A panel (10) for building construction comprising, first and second generally planar and rectangular faces (12, 14) having substantially equal sizes and disposed parallel to one another, each of said faces (12, 14) having first, second, third and fourth edges (1, 2, 3, 4), a first side (16) coupled between said second edge (2) of said first face (12) and said second edge (2) of said second face (14), a second side (20) coupled between said fourth edge (4) of said first face (12) and said fourth edge (4) of said second face (14), and at least one strip (32) disposed between said first and second faces (12, 14) so that the length of said strip is parallel to said second edge of said first face, said second edge of said second face, said fourth edge of said first face, and said fourth edge of said second face, said at least one strip (32, 68) defining a first projection (34) beyond said first edge (1) of said first face (12) and said first edge (1) of said second face (14), said first projection defining a tooth connection profile, wherein said first and second faces (12, 14) are made of plastic, and said at least one strip (32) is made of metal.

* * * * *